US005992907A

United States Patent [19]

Sheldon et al.

[11] Patent Number: 5,992,907

[45] Date of Patent: Nov. 30, 1999

[54] LOCK AND TILT LATCH FOR SLIDING WINDOWS

[75] Inventors: Cynthia L. Sheldon, Owatonna, Minn.; Stephen O. Myers, Naperville, Ill.; Robbin J. Delaske, Waterville; Joseph P. Landherr, Rose Creek, both of Minn.

[73] Assignee: Truth Hardware Corporation, Owatonna, Minn.

[21] Appl. No.: 09/066,940

[22] Filed: Apr. 27, 1998

[51] Int. Cl.[6] ..... E05C 1/06

[52] U.S. Cl. ..... 292/34; 292/38; 292/141; 292/DIG. 20

[58] Field of Search ..... 292/34, 35, 36, 292/37, 38, 139, 140, 141, DIG. 20, DIG. 47, 171, DIG. 25

[56] References Cited

U.S. PATENT DOCUMENTS

| | | | |
|---|---|---|---|
| 201,146 | 3/1878 | Adler | 292/6 |
| 336,302 | 1/1886 | Dudgeon | 292/36 |
| 480,148 | 8/1892 | Theby | 292/34 |
| 878,206 | 2/1908 | Johnson | 292/36 |
| 1,041,803 | 10/1912 | Kilburn | 292/36 |
| 1,059,999 | 4/1913 | James et al. | 292/36 |
| 1,253,810 | 1/1918 | Gianninoto | 292/207 |
| 1,393,628 | 10/1921 | Leichter | 292/210 |
| 1,550,532 | 8/1925 | French | 292/37 |
| 1,704,946 | 3/1929 | Lindgren | 292/5 |
| 1,901,974 | 3/1933 | Macy | 292/341.17 |
| 2,537,736 | 1/1951 | Carlson | 292/182 |
| 3,027,188 | 3/1962 | Eichstadt | 292/38 |
| 3,438,153 | 4/1969 | Lemme | 49/451 |
| 3,811,718 | 5/1974 | Bates | 292/241 |
| 4,227,345 | 10/1980 | Durham, Jr. | 49/181 |
| 4,305,612 | 12/1981 | Hunt et al. | 292/336.3 |
| 4,961,286 | 10/1990 | Bezubic | 49/175 |
| 5,072,464 | 12/1991 | Draheim et al. | 5/93.1 |
| 5,076,015 | 12/1991 | Manzalini | 49/192 |
| 5,087,088 | 2/1992 | Milam | 292/110 |
| 5,090,750 | 2/1992 | Lindqvist | 292/7 |
| 5,127,685 | 7/1992 | Dallaire et al. | 292/175 |
| 5,139,291 | 8/1992 | Schultz | 292/42 |
| 5,398,447 | 3/1995 | Morse | 49/185 |

FOREIGN PATENT DOCUMENTS

| | | |
|---|---|---|
| 341207 | 1/1931 | United Kingdom . |
| 2026594 | 2/1980 | United Kingdom . |

*Primary Examiner*—Darnell M. Boucher
*Assistant Examiner*—John B. Walsh
*Attorney, Agent, or Firm*—Wood, Phillips, VanSanten, Clark & Mortimer

[57] ABSTRACT

A position control mechanism for a double/single-hung window, including retractable plungers mountable on opposite sides of a window sash and received in a track on the frame to support the window sash for movement. An elongated member is secured at opposite ends to the plungers. A tilt latch actuator is mountable to the window sash between the plungers for pivoting about an axis, and includes a shaft with an opening therein oriented substantially radially relative to the axis and receiving the elongated member when secured to the first window sash. The ends of the shaft opening are substantially equal radial distances from the axis, and the elongated member is substantially linearly oriented when secured to the plungers with the plungers received in the one track. Guide openings defined by a bushing concentric with the axis are spaced from the shaft at substantially equal distances on opposite radial sides of the axis.

27 Claims, 6 Drawing Sheets

LOCK AND TILT LATCH FOR SLIDING WINDOWS

BACKGROUND OF THE INVENTION

1. Technical Field

The present invention is directed toward windows, and more particularly to tilt latches and sash locks for sliding or double/single-hung windows.

2. Background Art

Double/single-hung windows include two window sashes typically mounted for vertical movement along adjacent parallel tracks. Traditional double/single-hung window designs provide poor washability, because it is difficult for a person located inside the room to wash the outside of the window pane. To fully wash the outer surface of such windows (which outer surface is the one which is most often in need of cleaning), the person cleaning the window must typically go outside the dwelling. This is not only extremely inconvenient (as the person has to walk significant distances merely to wash both sides of a single window), it can also force a window washer, when trying to wash double/single-hung windows located at significant heights, to face the undesirable choice of either risking injury by climbing to that height or doing a relatively poor job of washing by merely reaching from a distance with a hose or a special long pole apparatus of some type. Such cleaning is still further complicated where there are screens or storm windows which must be removed prior to washing.

To overcome this problem, tilting latches for these types of windows have sometimes been provided. Such latches have generally been installed in opposite ends of a top horizontal rail of the upper and/or lower sash, and typically include a tongue or plunger which during normal operation extends out from the side of the sash into the sash track in the window frame to guide the sash for typical vertical movement. The tongue or plunger of each latch is retracted in some manner when washing is desired to free the top rail of the sash from the track so that the sash may be suitably pivoted inwardly about pivots guiding the bottom rail of the sash in the track and thereby allow the washer to easily reach the outside surface of the window pane of that sash.

The tongue or plunger in many of the prior art latches is commonly biased outwardly into the track by a spring structure or the like, with the tongue retracted inwardly by the washer manually pulling the tongues in toward the center of the top rail against the force of the spring (see, for example, U.S. Pat. No. 5,139,291). However, with such structures, the tongues can be difficult to move. Such problems can cause the person trying to retract the tongues to hurt their hands and, if the tongue is too difficult to move, they may just give up on trying to wash the window entirely and thereby lose the advantage of the latch structure completely.

Further, such tilt latches have typically had an assortment of complex structures which are difficult and time consuming (and therefore costly) to assemble.

Some attempts have also been made to control movement of the tongues by a pivoting lever or handle, occasionally functioning in combination with the sash lock (see, for example, U.S. Pat. Nos. 5,090,750 and 5,398,447). While this can aid in retracting the tongue, such latches have nevertheless encountered many of the above described problems (e.g., difficult, time consuming and costly to assemble, inadequately resistant to damage, and susceptible to allowing the window sash to inadvertently be inadequately secured to the track). Further, latches of this type, particularly those in which both sash locking and tilt latching are controlled, can have difficulty providing smooth, consistent and reliable operation over their long expected useful life. Still further, latches of this type can be difficult to install, as they typically require precise positioning in order to ensure that the tongues are retracted equally as required for proper operation. Also, such latches commonly also require that they be centrally positioned on the sash to ensure equal retraction, thereby making use of such latches in large window requiring multiple locks problematic. Additionally, even if properly installed initially, events occurring over the long expected life of such products (for example, slight slipping in connections or tensile distortion of components) can cause such latches to thereafter not function properly.

The present invention is directed toward overcoming one or more of the problems set forth above.

SUMMARY OF THE INVENTION

In one aspect of the present invention, a position control mechanism is provided for a window having retractable tilt/guide plungers on opposite sides of one sash. The mechanism includes a sash lock housing mountable to the window sash between the opposite sides of the sash, a cam lock pivotably supported on the housing for selective pivoting between sash locked and unlocked positions, and a tilt latch actuator disposed between the housing and the first window sash when the housing is mounted to the first window sash. The actuator includes a shaft pivotable about an axis relative to the housing and a flexible connector securable at opposite ends to the plungers. The shaft has an opening radially oriented relative to the axis, and the flexible connector extends through the shaft opening.

In another aspect of the present invention, a position control mechanism for a window is provided, including first and second retractable plungers mountable on opposite sides of the window sash and an elongated member secured at one end to the first plunger and at the other end to the second plunger. The plungers are received in a track on the frame to support the first window sash for movement within the frame. A tilt latch actuator is mountable to the window sash between the plungers for pivoting about an axis, and includes a shaft with an opening therein oriented substantially radially relative to the axis and receiving the elongated member when secured to the first window sash.

In yet another aspect of the present invention, a double/single-hung window is provided, including a window frame, at least one track defined on both sides of the window frame, and first and second window sashes with at least the first window sash being guided for movement within the frame by the track. First and second plungers are on opposite sides of the first window sash and biased into the one track for guiding movement of the first window sash within the frame, with an elongated member secured at one end to the first plunger and at the other end to the second plunger. A tilt latch actuator is mounted to the first window sash between the plungers for pivoting about an axis, and includes a shaft with an opening therein oriented substantially radially relative to the axis. The shaft opening receives the elongated member.

In preferred forms of the above aspects of the present invention, the ends of the shaft radial opening are substantially equal radial distances from the axis, and the flexible connector/elongated member is substantially linearly oriented when secured to the plungers with the plungers received in the one track.

In another preferred form of the above aspects of the present invention, first and second guide openings receive the flexible connector/elongated member at substantially equal distances on opposite radial sides of the axis. In a preferred form, a bushing concentric with the pivot axis defines the guide openings on opposite sides of the shaft. In another preferred form, the guide openings lie on a radius of the axis and the radius substantially corresponds to the orientation of the flexible connector/elongated member when the plungers are received in the one track.

In still another preferred form of the above aspects of the present invention, the flexible connector/elongated member is a band with the shaft opening radially oriented along its length and axially oriented along its width, and in yet another preferred form the shaft opening is open on one axial end whereby the shaft may be moved axially during installation to receive any portion of the flexible connector/elongated member in the shaft opening.

It is an object of the invention to provide windows which are reliably secure for normal operation, while also allowing for easy maintenance.

It is another object of the invention to provide windows which may be easily washed.

It is still another object of the invention to provide windows which may be easily and reliably moved over a long life while also providing security against intruders.

It is yet another object of the invention to provide windows which may be easily tilted inwardly when desired, with such object being reliably provided over a long life.

Another object of the invention is to provide hardware for windows which may be easily, reliably, quickly and inexpensively assembled and installed in the window.

Still another object of the invention is to provide hardware for windows which will continue to operate properly notwithstanding changing conditions such as occur over its expected long useful life.

Yet another object of the invention is to provide visually unintrusive tilt latch hardware for windows.

Another object of the invention is to provide lock and tilt latch hardware for windows which may be reliably used with large windows.

Still another object of the invention is to provide tilt latch hardware for windows which may provide the above advantages at various positions on the window sash.

Yet another object of the invention is to provide tilt latch hardware which may be used with window sashes made of a wide variety of materials, including vinyl and wood.

DESCRIPTION OF THE PREFERRED EMBODIMENT

Figure 1:
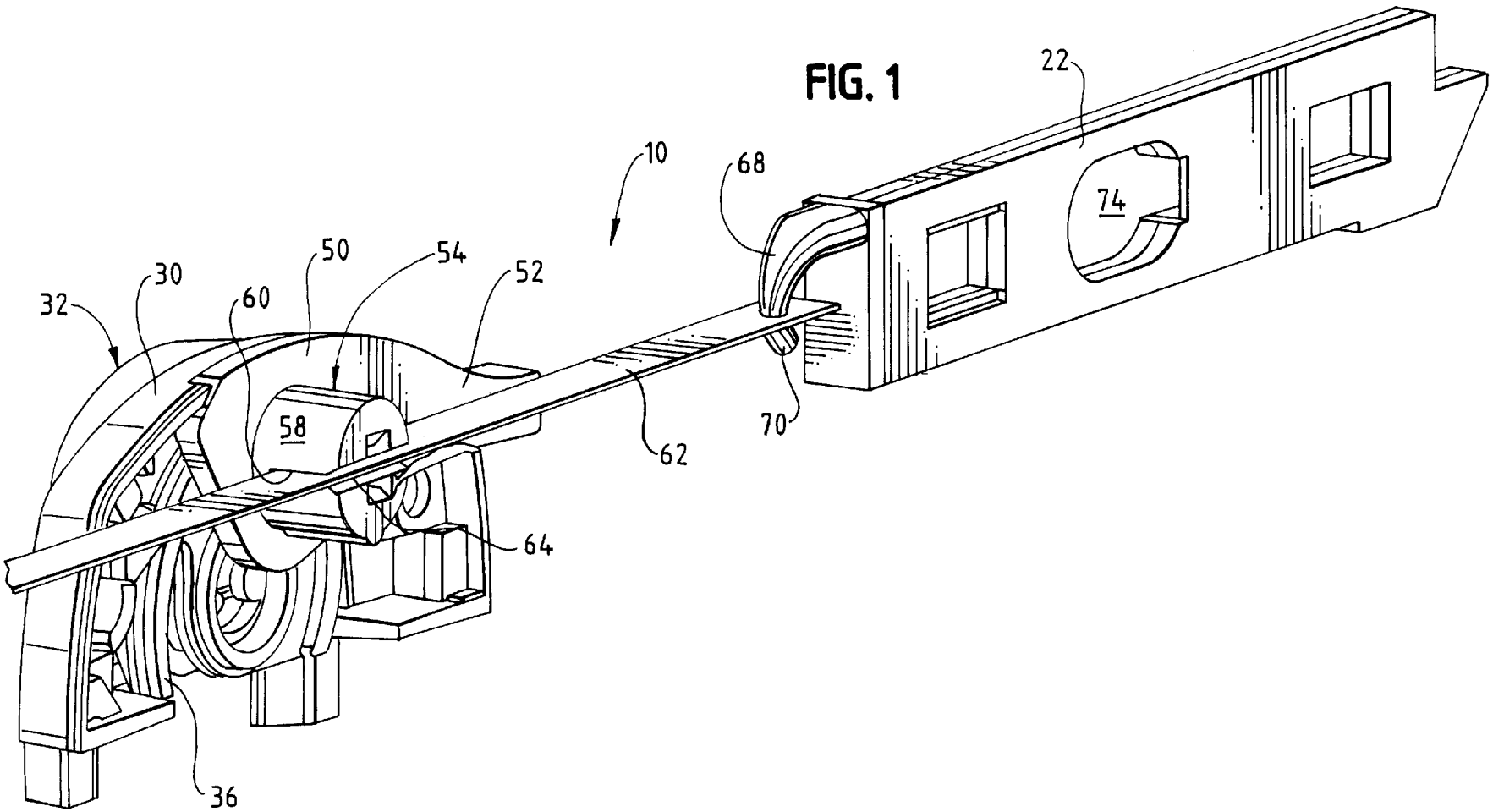
FIG. 1 is a partial perspective view from the bottom of a tilt latch and lock mechanism made according to the present invention.
Figure 2:
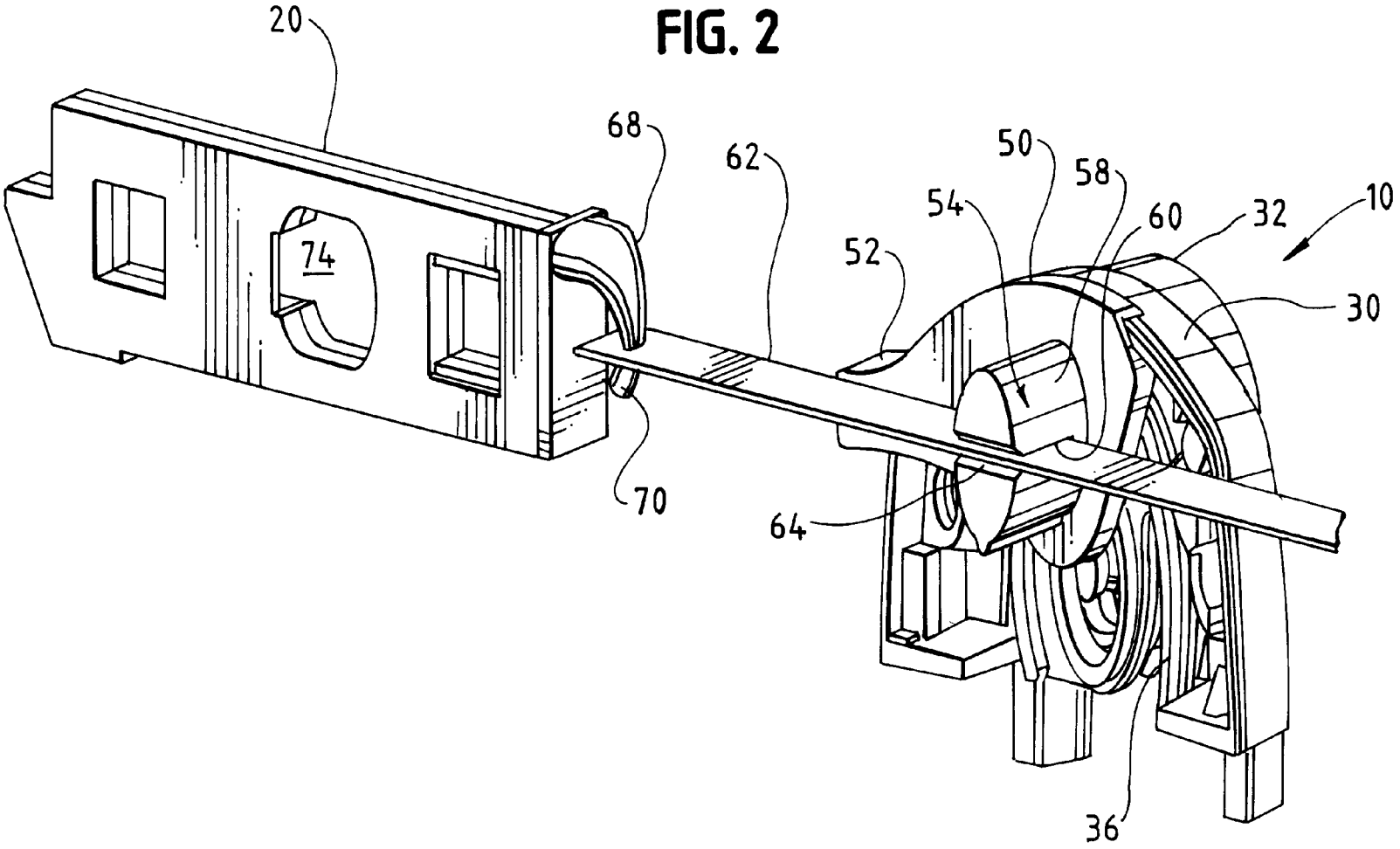
FIG. 2 is a second partial perspective view, similar to FIG. 1, showing a tilt latch and lock mechanism made according to the present invention.
Figure 3:
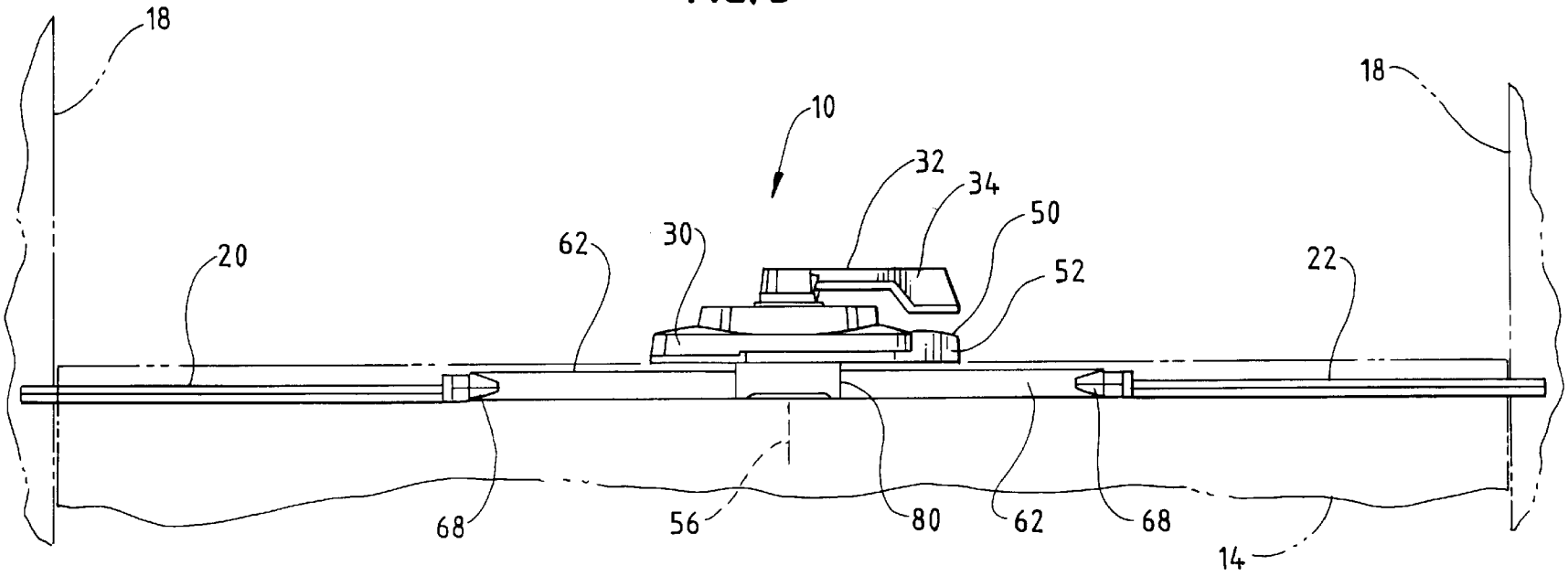
FIG. 3 is side view of a tilt latch and lock mechanism made according to the present invention, with the window structure shown in phantom.
Figure 4:
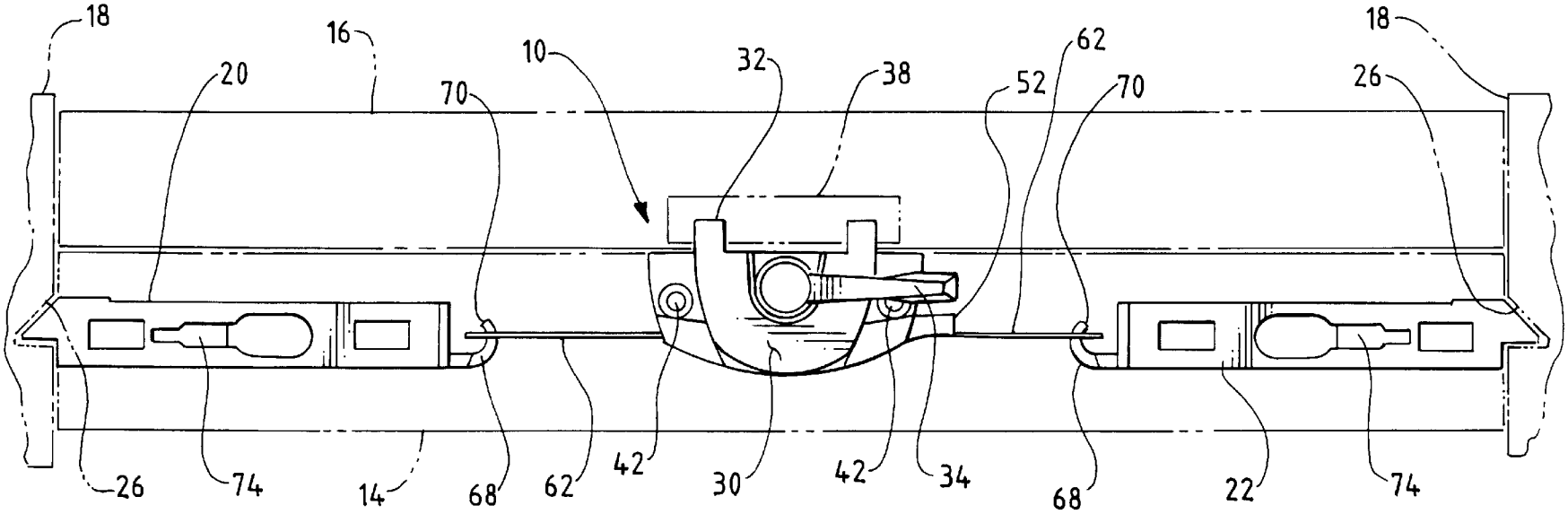
FIG. 4 is top view, similar to FIG. 3, of a tilt latch and lock mechanism made according to the present invention.
Figure 5:
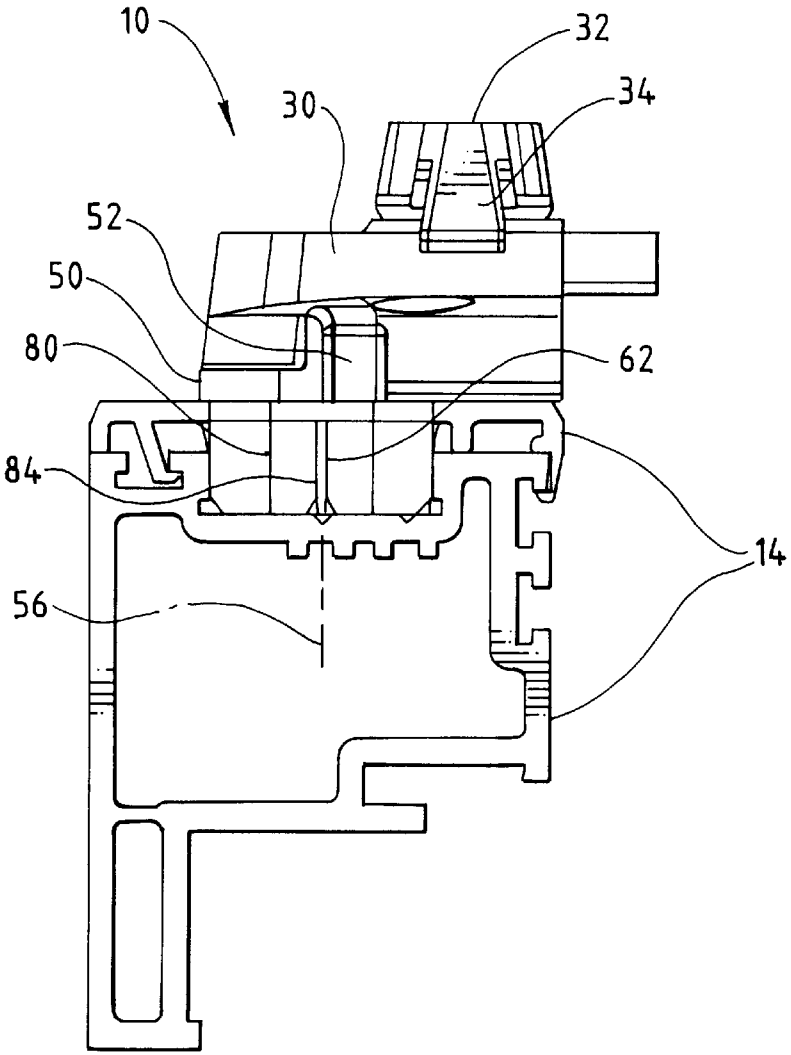
FIG. 5 is a side cross-sectional view of a top rail of a window sash illustrating a preferred embodiment of the present invention.

A tilt latch and lock mechanism 10 embodying the present invention is shown in FIGS. 1–2. The mechanism 10 is mountable in a window, which includes a pair of window sashes 14, 16 typically movable in parallel paths within a vertically oriented window frame 18. It will be understood by those skilled in this art that this mechanism 10 is particularly suitable for double/single-hung windows such as shown, although it should also be recognized the present invention could also be used with still other window types.

As is known in the art, retractable plungers 20, 22 are secured to opposite sides of the upper rail of one window sash 14 (typically the one which moves in the path which is toward the interior side of the frame 18, and is also the sash which is at the bottom of the frame 18 when the two sashes 14, 16 are locked shut). Such plungers 20, 22 are typically recessed in the sash 14 so as to not visually intrude into the window opening, and are biased outwardly into a track 26 in the frame 18 for guiding movement of the sash 14.

The mechanism 10 includes a sash lock housing 30 which supports a check rail lock 32. The check rail lock 32 includes a locking handle 34 disposed on top of the housing 30, and fixed by a pivoting shaft extending through the housing 30 to a rotatable locking cam 36. The handle 34 when pivoted extends (for locking) or retracts (for unlocking) the locking cam 36, to engage (to lock) or release (to unlock) a keeper 38 which is secured on the other sash 16 so as to be aligned with the check rail lock 32 when the two sashes 14, 16 are in their closed positions.

As will be appreciated once the present disclosure is fully understood, a wide variety of window lock structures could be used with the present invention, with the basic lock 32 described above being an example of one such suitable lock structure. Check rail lock structures with which the present invention could be used include those shown, for example, in U.S. Pat. Nos. 3,811,718, 4,095,829, 4,736,972, 4,801,164, 5,110,165, 5,161,839, and 5,219,193, the complete disclosures of which are hereby fully incorporated by reference.

The sash lock housing 30 is secured to the sash 14 in a suitable manner, such as by the screws 42 shown.

Disposed between the sash 14 and the check rail lock 32 is a tilt latch actuator 50. The actuator 50 includes a handle portion 52 and a shaft portion 54. The shaft portion 54 is suitably supported for pivoting about an axis 56 relative to the lock 32 and sash 14. For example, the actuator 50 may be pivotally secured in an annular opening in the sash 14, in which case the actuator 50 need not be fixed to the lock housing 30 except insofar as it is trapped between the housing 30 and the sash 14 when mounted, although it will be recognized that many other pivotal mountings could alternatively be used. In the preferred embodiment, a cutout in the lock housing 30 is provided with the actuator 50 essentially blocking the opening through the cutout when the actuator 50 is an a normal position (not retracting the plungers 20, 22), and the cutout allowing the actuator 50 to pivot through the range required to retract the plungers 20, 22 when desired.

The shaft portion 54 preferably includes an outer surface which is substantially concentric about the axis 56 (e.g., is substantially cylindrical). The shaft portion 54 also includes a slot 60 which is generally radially oriented (i.e., has a length which extends substantially along a plane which includes the axis 56), with the ends of the slot 60 being at substantially equal distances on opposite sides of the axis 56.

A band 62 extending between the plungers 20, 22 is disposed in the slot 60 during installation, with the bottom 64 of the slot 60 preferably flared outwardly to assist in guiding the band into the slot 60 as described further hereafter.

In the illustrated embodiment, the band 62 is suitably secured at opposite ends to hooks 68 on the interior ends of the plungers 20, 22. Barbs 70 may be provided on the hooks 68 to assist in maintaining the band 62 on the hooks 68. Once the invention described herein is fully understood, it will be recognized that the band 62 could be a different type of connecting member, such as a nylon strapping, cord, wire, cable, etc. suitably secured to the plungers 20, 22. In the preferred embodiment, substantially all of the connecting member is flexible, although it will be recognized hereafter than it is sufficient if only the portion located at the shaft portion 54 be flexible.

Preferably, the band 62 is substantially linearly oriented with minimal slack when secured to the plungers 20, 22 when the plungers 20, 22 are in their extended positions received in the track 26. Suitable spring members 74 are used to bias the plungers 20, 22 outwardly from the sash 14 into the track 26, with the band 62 being used to retract the plungers 20, 22 to release them from the track 26 to allow for tilting of that side of the sash 14 from the frame 18 for washing, etc.

Assembly of the mechanism 10 is thus simple, reliable and inexpensive. Since the slot 60 is open on one axial end, the band 62 may first be installed, stretching in a substantially linear orientation between the plungers 20, 22, with the actuator 50 then moved down over the band 62, the band 62 thereby being automatically positioned in the slot 60 at the appropriate point along its length. Alternatively, the band 62 could be first positioned in the slot 60, with the actuator 50 then installed on the sash 14 and the ends of the band 62 thereafter secured between the plungers 20, 22. In that case, the band 62 would still be free to move along its length in the slot 60 until, when properly secured at both ends to the plungers 20, 22, it will automatically be properly positioned in the slot 60 of the actuator shaft portion 54. In the latter case, the shaft portion slot could be closed on one end with the band 62 threaded through the slot before securing it to both plungers 20, 22.

The free longitudinal movement of the band 62 in the slot 60 not only simplifies installation as discussed above, but also allows for some degree of self correction of the mechanism 10 over time. For example, should the band 62 on one side of the mechanism 10 stretch more than on the other, or should the connection of the band 62 to one of the plungers 20, 22 slip, the band 62 will be free to shift within the slot 60 to ensure that equal tension is maintained on both sides of the mechanism 10. Therefore, the potential problem in which pivoting of the actuator 50 would not retract the plungers 20, 22 substantially equally is effectively eliminated, not only during installation but also during the life of the mechanism 10.

In the preferred embodiment, a bushing 80 is also provided defining a pair of guide slots 84 spaced from the actuator shaft portion 54 at substantially equal distances on opposite sides of the axis 56. Though the bushing 80 is shown as generally cylindrical, once the present invention is understood it will be appreciated that the placement of the guide slots 84 defined by the bushing 80 is what is significant, and the bushing 80 could be other shapes, or the guide slots 84 could be defined by separate components without use of a bushing at all.

As will be also appreciated (from FIGS. 6A and 6B), the use of such guide slots 84 secures the band 62 so that it moves only linearly between the plungers 20, 22 and the bushing 80. Therefore, only a narrow slot needs be provided in the sash 14 for the band 62 along those distances. As such the tilt latch actuator 50 can be used not only with vinyl windows (which typically are provided with interior open spaces) but also with wood windows, as only small amounts of wood need be removed from the sash to make room for the hardware. That is, all that is required is space at the sash sides for the plungers 20, 22 (such as typically already provided), plus a small space at the actuator 50 (for the bushing 80 and shaft portion 54), and narrow drilled or sawed slots between the bushing 80 and the plungers 20, 22. Thus, installation of this structure even in wood windows may be easily done without destroying the surface appearance of the wood and/or weakening the sash rail in any significant manner.

Further, use of such guide slots 84 provide significant operational advantages.

Figure 6A:
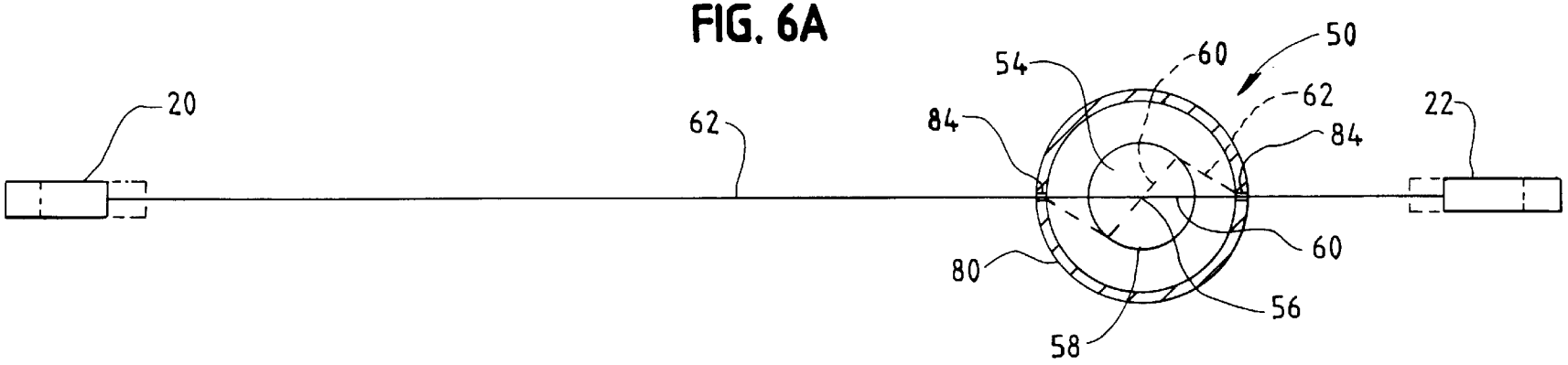
FIGS. 6A and 6B are schematic illustrations of the operation of the present invention with (FIG. 6A) and without (FIG. 6B) a bushing.
Figure 6B:
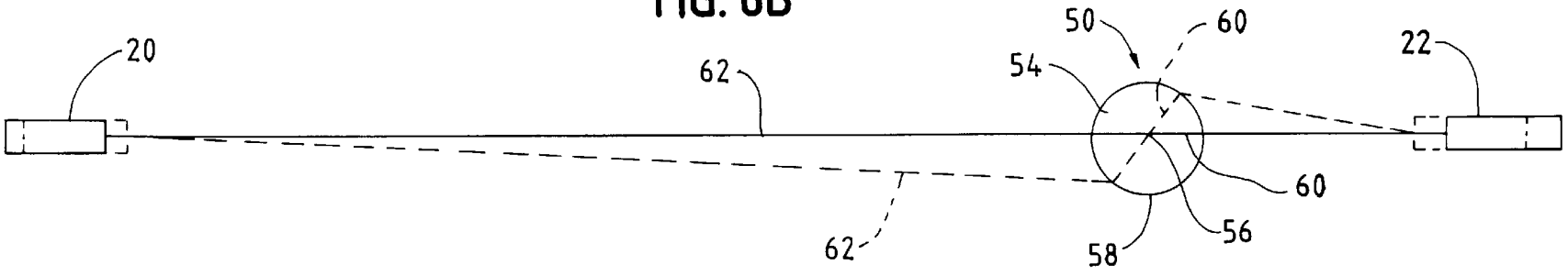

First, this allows the mechanism 10 to be placed at any point along the sash 14 while still ensuring that both plungers 20, 22 are retracted an equal amount. That is, as illustrated by FIG. 6A, since the displacement of the band 62 outside the bushing 80 is linear, and the displacement inside the bushing 80 is the same on both sides of the actuator shaft portion 54, the retraction of the plungers 20, 22 on both ends will be identical. Where a bushing 80 is not used, as shown in FIG. 6B, the displacement of the band 62 (and thus the retraction of the plungers 20, 22) is different when the actuator 50 is not centrally located between the plungers 20, 22, and thus the plungers 20, 22 are not retracted equal amounts. Therefore, the use of guide slots 84 with the present invention is particularly advantageous for use with large windows, with which two check rail locks may be located at equal spacing on the sash 14, since the actuator 50 can be used with one of such offset locks.

Second, for any given installation, the addition of guide slots 84 result in the amount of retraction of the plungers 20, 22 to be greater for a given amount of pivoting of the actuator 50 than if no guide slots 84 are provided (as would be shown by any simple trigonometric analysis of FIGS. 6A and 6B). Therefore, it will be appreciated that the operator will either be able to more easily use the actuator 50, since it will need to be pivoted a minimal amount or, alternatively, a desired length of retraction can be provided by requiring the same angle of pivoting while decreasing the size (diameter) of the actuator shaft portion 54.

Of course, the freedom of the band 62 to move longitudinally in the guide slots 84, for those embodiments in which guide slots 84 are used, in cooperation with the free movement in the shaft portion slot 60 provides the advantages described above in discussing the similar freedom of movement in the shaft portion slot 54 (e.g., simplified installation and ensured equal retraction of the plungers 20, 22 not only initially but also over the life of the mechanism 10).

It should now be recognized that the mechanism 10 can be used to provide windows which are reliably secure for normal operation with smooth movement, while also providing not only security against intruders but also easy maintenance, including washing. Moreover, these advantages are provided over the long useful life expected of window hardware, with the mechanism 10 automatically adapting to changing conditions which can arise over such a life. Further, the mechanism 10 can be reliably and inexpensively assembled and installed in the window, and can be installed without visually detracting from the look through the window. Still further, the mechanism can be readily used in any position on the top sash rail without detracting from its performance, thereby making it particularly useful for large windows where central location of a lock is often not appropriate. Also, the mechanism 10 is suitable for use with a wide variety of window materials, including not only vinyl windows but also wood windows.

Still other aspects, objects, and advantages of the present invention can be obtained from a study of the specification, the drawings, and the appended claims.

We claim:

1. A position control mechanism for a window, said window having a window frame, at least one track defined on both sides of the window frame, first and second window sashes, and retractable plungers on opposite sides of said first window sash received in said one track for supporting said first window sash for movement within said frame, said mechanism comprising:

a sash lock housing mountable to the first window sash between the opposite sides of the sash;

a cam lock pivotably supported on the housing for selective pivoting between an unlocked position and a locked position, said cam lock in the locked position being engageable with a keeper on the second window sash when the sash lock housing is mounted to the first window sash for securing the first and second window sashes against movement relative to the frame;

a tilt latch actuator disposed between the housing and the first window sash when the housing is mounted to the first window sash, said actuator including a shaft pivotable about an axis relative to the housing, said shaft having an opening radially oriented relative to the axis, a flexible connector securable at opposite ends to the plungers when the housing is mounted to the first window sash, said flexible connector extending through said shaft opening, and first and second guide openings receiving said flexible connector therethrough, said guide openings being at fixed locations spaced from said axis at substantially equal distances on opposite radial sides of said axis.

2. The position control mechanism of claim 1, wherein the ends of said shaft opening are substantially equal radial distances from said axis.

3. The position control mechanism of claim 1, wherein said flexible connector is substantially linearly oriented when secured to said plungers with said plungers received in said one track.

4. The position control mechanism of claim 1, wherein said guide openings are defined by a bushing concentric with said shaft and defining said first and second guide openings on opposite sides thereof.

5. The position control mechanism of claim 1, wherein the flexible connector is a band, and the shaft opening is radially oriented along its length and axially oriented along its width.

6. The position control mechanism of claim 1, wherein said guide openings lie on a radius of said axis, said radius substantially corresponding to the orientation of the flexible connector when secured to said plungers with said plungers received in said one track.

7. The position control mechanism of claim 6, wherein said flexible connector is substantially linearly oriented when secured to said plungers with said plungers received in said one track.

8. A position control mechanism for a window, said window having a window frame, at least one track defined on both sides of the window frame, first and second window sashes, and retractable plungers on opposite sides of said first window sash received in said one track for supporting said first window sash for movement within said frame, said mechanism comprising:

a sash lock housing mountable to the first window sash between the opposite sides of the sash;

a cam lock pivotably supported on the housing for selective pivoting between an unlocked position and a locked position, said cam lock in the locked position being engageable with a keener on the second window sash when the sash lock housing is mounted to the first window sash for securing the first and second window sashes against movement relative to the frame;

a tilt latch actuator disposed between the housing and the first window sash when the housing is mounted to the first window sash, said actuator including a shaft pivotable about an axis relative to the housing, said shaft having an opening radially oriented relative to the axis and open on one axial end whereby said shaft may be moved axially during installation to receive any portion of said flexible connector in said shaft opening, a flexible connector securable at opposite ends to the plungers when the housing is mounted to the first window sash, said flexible connector extending through said shaft opening.

9. A position control mechanism for a window, said window having a window frame, at least one track defined on both sides of the window frame, and first and second window sashes, said mechanism comprising:

first and second retractable plungers mountable on opposite sides of said first window sash, said plungers received in said one track for supporting said first window sash for movement within said frame when mounted to said first window sash;

an elongated member secured at one end to said first plunger and at the other end to said second plunger;

a tilt latch actuator mountable to the first window sash between said plungers for pivoting about an axis, said actuator including a shaft with a radial opening therein oriented substantially radially relative to said axis and receiving said elongated member when secured to the first window sash, said shaft radial opening further being open on one axial end whereby said shaft may be moved axially during installation to receive any portion of said elongated member in said shaft radial opening.

10. The position control mechanism of claim 9, further comprising:

a sash lock housing mountable to the first window sash between the opposite sides of the sash; and a cam lock pivotably supported on the housing for selective pivoting between an unlocked position and a locked position, said cam lock in the locked position being engageable with a keeper on the second window sash when the sash lock housing is mounted to the first window sash for securing the first and second window sashes against movement relative to the frame, wherein said tilt latch actuator is disposed between said sash lock housing and said first window sash when said housing and said actuator are mounted to the first window sash.

11. The position control mechanism of claim 9, wherein the ends of said shaft radial opening are substantially equal radial distances from said axis.

12. The position control mechanism of claim 9, wherein said elongated member is substantially linearly oriented when said plungers are mounted on said first window sash and received in said one track.

13. The position control mechanism of claim 9, wherein the elongated member is a band, and the shaft radial opening is radially oriented along its length and axially oriented along its width.

14. A position control mechanism for a window, said window having a window frame, at least one track defined on both sides of the window frame, and first and second window sashes, said mechanism comprising:

first and second retractable plungers mountable on opposite sides of said first window sash, said plungers received in said one track for supporting said first window sash for movement within said frame when mounted to said first window sash;

an elongated member secured at one end to said first plunger and at the other end to said second plunger;

a tilt latch actuator mountable to the first window sash between said plungers for pivoting about an axis, said actuator including a shaft with a radial opening therein oriented substantially radially relative to said axis and receiving said elongated member when secured to the first window sash; and first and second guide openings receiving said elongated member therethrough, said guide openings being at fixed locations spaced from said axis at substantially equal distances on opposite radial sides of said axis.

15. The position control mechanism of claim 14, further comprising:

a sash lock housing mountable to the first window sash between the opposite sides of the sash; and a cam lock pivotably supported on the housing for selective pivoting between an unlocked position and a locked position, said cam lock in the locked position being engageable with a keeper on the second window sash when the sash lock housing is mounted to the first window sash for securing the first and second window sashes against movement relative to the frame, wherein said tilt latch actuator is disposed between said sash lock housing and said first window sash when said housing and said actuator are mounted to the first window sash.

16. The position control mechanism of claim 14, wherein said guide openings are defined by a bushing concentric with said shaft and defining said first and second guide openings on opposite sides thereof.

17. The position control mechanism of claim 14, wherein said guide openings lie on a radius of said axis, said radius substantially corresponding to the orientation of the elongated member when said plungers are mounted on said first window sash.

18. The position control mechanism of claim 17, wherein said elongated member is substantially linearly oriented when said plungers are mounted on said first window sash and received in said one track.

19. A double-hung window, comprising:

a window frame;

at least one track defined on both sides of the window frame;

first and second window sashes, at least said first window sash being guided for movement within said frame by said track;

first and second plungers on opposite sides of said first window sash, said plungers being biased into said one track for guiding movement of said first window sash within said frame;

an elongated member secured at one end to said first plunger and at the other end to said second plunger;

a tilt latch actuator mounted to the first window sash between said plungers for pivoting about an axis, said actuator including a shaft with an opening therein oriented substantially radially relative to said axis and receiving said elongated member; and said shaft opening further being open on one axial end whereby said shaft may be moved axially during installation to receive any portion of said elongated member in said shaft opening.

20. The double-hung window of claim 19, further comprising:

a sash lock housing mounted to the first window sash between said plungers, said tilt latch actuator being disposed between said sash lock housing and said first window sash;

a keeper on the second window sash and disposed adjacent the sash lock housing when the window sashes are in a closed position;

a cam lock pivotably supported on the housing for selective pivoting between an unlocked position and a locked position, said cam lock in the locked position being engageable with said keeper for securing the first and second window sashes against movement relative to the frame.

21. The double-hung window of claim 19, wherein the ends of said shaft opening are substantially equal radial distances from said axis.

22. The double-hung window of claim 19, wherein said elongated member is substantially linearly oriented when said plungers are in said one track.

23. The double-hung window of claim 19, wherein the elongated member is a band, and the shaft opening is radially oriented along its length and axially oriented along its width.

24. A double-hung window, comprising:

a window frame;

at least one track defined on both sides of the window frame;

first and second window sashes, at least said first window sash being guided for movement within said frame by said track;

first and second plungers on opposite sides of said first window sash, said plungers being biased into said one track for guiding movement of said first window sash within said frame;

an elongated member secured at one end to said first plunger and at the other end to said second plunger; and a tilt latch actuator mounted to the first window sash between said plungers for pivoting about an axis, said actuator including a shaft with an opening therein oriented substantially radially relative to said axis and receiving said elongated member; and first and second guide openings receiving said elongated member therethrough, said guide openings being at fixed locations spaced from said axis at substantially equal distances on opposite radial sides of said axis.

25. The double-hung window of claim 24, wherein said guide openings are defined by a bushing concentric with said shaft and defining said first and second guide openings on opposite sides thereof.

26. The double-hung window of claim 24, wherein said guide openings lie on a radius of said axis, said radius substantially corresponding to the orientation of the elongated member when said plungers are in said one track.

27. The double-hung window of claim 26, wherein said elongated member is substantially linearly oriented when said plungers are in said one track.

* * * * *